US009389589B2

(12) United States Patent
Lagorgette

(10) Patent No.: US 9,389,589 B2
(45) Date of Patent: Jul. 12, 2016

(54) CONTROL METHOD FOR AN ANALOGUE DISPLAY FITTED TO A TIMEPIECE MOVEMENT

(71) Applicant: ETA SA Manufacture Horlogere Suisse, Grenchen (CH)

(72) Inventor: Pascal Lagorgette, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/562,824

(22) Filed: Dec. 8, 2014

(65) Prior Publication Data

US 2015/0168917 A1 Jun. 18, 2015

(30) Foreign Application Priority Data

Dec. 13, 2013 (EP) ..... 13197171

(51) Int. Cl.

| | |
|---|---|
| ***G04B 19/24*** | (2006.01) |
| ***G04C 3/00*** | (2006.01) |
| ***G04C 3/14*** | (2006.01) |
| ***G04C 17/00*** | (2006.01) |

(52) U.S. Cl.

CPC *G04B 19/24* (2013.01); *G04C 3/00* (2013.01); *G04C 3/14* (2013.01); *G04C 3/146* (2013.01); *G04C 17/0058* (2013.01)

(58) Field of Classification Search

CPC ..... G04C 3/14; G04C 17/00; G04C 17/0058; G04C 17/0066; G04C 3/146; G04C 3/00; G04B 19/24

See application file for complete search history.

(56) References Cited

U.S. PATENT DOCUMENTS

| | | | | |
|---|---|---|---|---|
| 4,695,168 | A * | 9/1987 | Meister et al. | 368/31 |
| 4,775,963 | A * | 10/1988 | Soltermann et al. | 368/31 |
| 5,274,614 | A * | 12/1993 | Yamazaki | 368/28 |
| 6,081,483 | A * | 6/2000 | Capt et al. | 368/28 |
| 6,185,158 | B1 | 2/2001 | Ito et al. | |
| 2001/0042680 | A1 * | 11/2001 | Grupp | 200/512 |
| 2006/0285444 | A1 * | 12/2006 | Burkhardt et al. | 368/37 |
| 2008/0084792 | A1 * | 4/2008 | Hayashi et al. | 368/80 |

OTHER PUBLICATIONS

European Search Report issued Sep. 11, 2014 in European Application 13197171, filed on Dec. 13, 2013 ( with English Translation).

* cited by examiner

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

In the control method for an analog display device fitted to a timepiece movement, the motor is used both for driving a first indicator of a time parameter and a second periodically driven indicator. To this end, the motor is controlled such that, when the first indicator is in an operating mode and the second indicator is arranged to remain substantially immobile, said first indicator is driven in rotation by the motor alternately. The first indicator is driven in a forward direction, to display the time parameter, during a first period in which a periodic actuation wheel set is simultaneously driven in positions of its area of non-actuation, and in a backward direction, in accelerated mode, during a second period following the first period, before the periodic actuation wheel set is driven in a position of its area of actuation.

8 Claims, 2 Drawing Sheets

CONTROL METHOD FOR AN ANALOGUE DISPLAY FITTED TO A TIMEPIECE MOVEMENT

This application claims priority from European Patent Application No. 13197171.5 filed Dec. 13, 2013 the entire disclosure of which is incorporated herein by reference.

FIELD OF THE INVENTION

The present invention concerns the field of timepiece movements fitted with an analogue display for several parameters, at least part of which concerns time data. Other displayed parameters may be associated with various functions or with the selection of such functions. The present invention particularly concerns electronic timepiece movements including an analogue display driven by one or more electromechanical motors.

BACKGROUND OF THE INVENTION

There is known, in particular from U.S. Pat. No. 6,185,158, an electronic watch fitted with an analogue display for several time parameters, in particular the hours, minutes and seconds, by means of three coaxial hands at the centre of the watch dial. Further, the analogue display includes a chronograph hand, in particular a minute hand for the measured time interval, associated with a circular graduation over 360°, and a date display utilising a date ring, the displayed date appearing in conventional manner through an aperture in the dial. This Patent proposes to actuate the mechanism driving the chronograph hand (hereafter the "first mechanism") and the mechanism driving the date ring (hereafter the "second mechanism") via one and the same electromechanical motor. In the embodiment described, the first mechanism must not be associated with the display of the current hour, minute or second or of another function connected to these time parameters, whereas the second mechanism must be of the intermittent drive type, as is the case for the date display.

The first mechanism includes an intermediate wheel driven directly by the rotor of the motor and a chronograph wheel that meshes with the intermediate wheel. The second mechanism also includes said intermediate wheel and also an auxiliary wheel meshing with said intermediate wheel. The auxiliary wheel is integral with a wheel set that periodically actuates a wheel driving the date ring, this wheel set having a finger for actuating the drive wheel. The periodic actuation wheel set and the drive wheel together form a Geneva mechanism, known for periodically driving a date ring/disc. On each revolution of the periodic actuation wheel set, the finger drives the date ring drive wheel, which is driven in rotation over an angular distance corresponding to the change from one date to the next in the aperture in the dial provided for the date display. The Geneva mechanism is thus characterized by the periodic driving of the date ring drive wheel, with the periodic actuation wheel set only meshing with the drive wheel over an angular sector of less than 360°, whereas the wheel set locks the drive wheel on the remaining angular sector. Thus, although the periodic actuation wheel set rotates when positioned in the remaining angular sector, the rotational motion of the rotor is not transmitted to the date ring.

U.S. Pat. No. 6,185,158 uses the Geneva mechanism to enable the motor used for driving the date mechanism to perform an additional function, namely driving a chronograph hand. In short, the method consists in driving the chronograph hand when said periodic actuation wheel set is in its area of non-actuation, i.e. in said remaining angular sector, and, at the end of the measured time interval, in performing a reverse reset to return the periodic actuation wheel set to a predefined initial position. To achieve this, the chronograph hand is arranged to make only one revolution and is driven such that one complete revolution leaves the periodic actuation wheel set in its area of non-actuation. In fact, the seconds hand and the chronograph minute hand are arranged to be used in chronograph mode. Thus, there is no counter indicating the number of revolutions made by the chronograph minute hand, so that the maximum time interval able to be measured corresponds to a single revolution of the chronograph hand concerned. Stopping the chronograph within this maximum time interval or at the end thereof, ensures that the date disc is never driven.

The method for controlling the analogue display device for a chronograph hand and date according to the aforementioned prior art raises at least two major objective problems. First of all, this method is essentially limited to a chronograph hand displaying the highest time unit that can be counted by the chronograph display. Indeed, if it is desired to introduce an hour counter (for example up to three hours) in addition to the 10 minute counter provided (FIG. 1), the control method proposed is no longer suitable since said periodic actuation wheel set is then liable to make eighteen revolutions over the maximum time interval that can be measured; which, in the example set out in U.S. Pat. No. 6,185,158 would change the date four times during the measured time. Secondly, the date ring is inadvertently driven if a user forgets to stop the chronograph substantially within the maximum time interval provided (ten minutes) or at the end thereof. Of course, the area of non-actuation provided is sufficient to allow the minute counter to complete three revolutions before actuating the date ring. However, if the user forgets to stop the chronograph function for any reason, hours may pass before he or she realises. In that case, the date display will be changed in error. Further, the chronograph mode may be unintentionally started, which leads to the same result.

SUMMARY OF THE INVENTION

It is an object of the present invention to overcome the aforementioned problems of the prior art.

To this end, the present invention concerns a control method for an analogue display device fitted to a timepiece movement of the type described above, this method being characterized in that the motor, serving to drive both a first indicator of a time parameter and a periodically driven second indicator, is controlled by the timepiece movement so that, when the first indicator is in an operating mode and the second indicator is arranged to remain substantially immobile, the first indicator is driven in rotation by the motor alternately.

Specifically, the first indicator is driven in a forward direction, to display the first time parameter, during a first period in which a wheel set for periodically actuating the second indicator is simultaneously driven in positions of its area of non-actuation, and in a backward direction, in accelerated mode during a second period following the first period, before the periodic actuation wheel set is driven in a position of its area of actuation. The reverse actuation of the motor, for driving the first indicator in a backward direction, is achieved such that the first indicator correctly displays the first time parameter when the motor is operated in the forward direction again for a following new first period.

The method according to the invention overcomes the problems of the prior art by introducing a periodic backward rotation of the aforementioned time parameter indicator when said indicator is operating, i.e. when the function that it displays is actuated and therefore when the time parameter displayed varies gradually over a circular graduation. Thus, for example, during a time interval measurement, the chronograph hand associated with the multi-function motor can take several successive backward steps, at regular intervals and in an accelerated manner, so that, regardless of the time interval measured, the second periodically driven indicator remains continuously in the same given position.

According to a particular embodiment, the second display is the display of the unit or the tens of a "grande date" or "large date", the display of the tens, or respectively the units, being achieved by a third indicator driven by a second motor, which also drives a fourth indicator associated with a fourth display for a time parameter. The third and fourth indicators are respectively controlled in the same manner as the second and first indicators according to the control method of the invention.

Other particular features and applications of the method of the invention will be set out below in the detailed description of the invention.

BRIEF DESCRIPTION OF THE DRAWINGS

The invention will be described below with reference to the annexed drawings, given by way of non-limiting example, and in which.

DETAILED DESCRIPTION OF THE INVENTION

Figure 1:
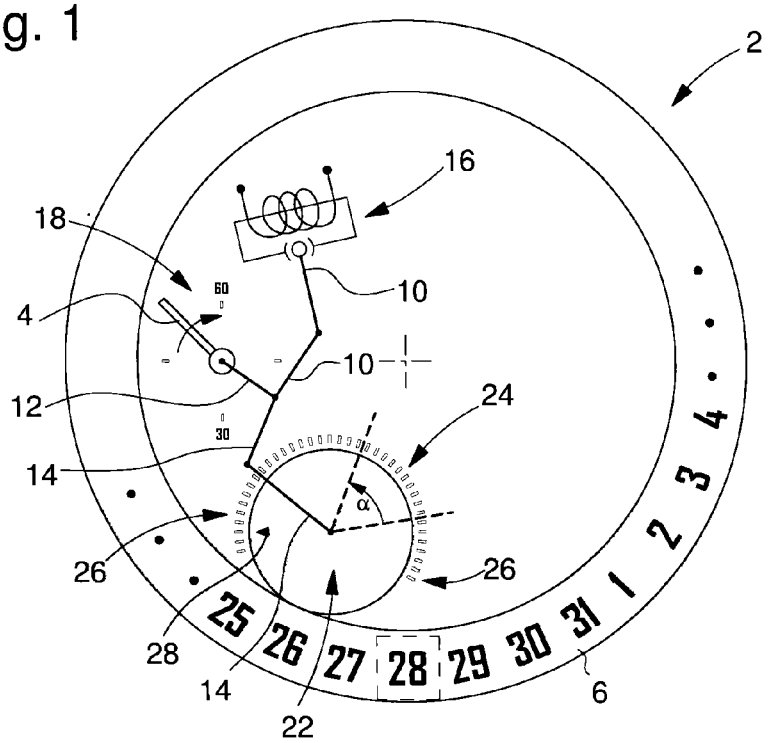
FIG. 1 is a schematic, plan view of a first embodiment of a timepiece movement, used as the basis for the following general explanation of the control method for an analogue display device according to the invention.

The control method of the invention for an analogue display device fitted to a timepiece movement 2 will be described hereafter in a general manner with reference to the schematic drawing of FIG. 1.

The analogue display device includes a first indicator 4 associated with a first display of a first time parameter, particularly the minutes of a measured time interval, and a second indicator 6 associated with a second display of a second parameter, in particular the date. The first and second indicators are respectively associated with a first drive mechanism, formed by a first kinematic chain 10 and 12, and with a second drive mechanism, formed by a second kinematic chain 10, 14 and 22. According to the invention, the first and second drive mechanisms are actuated by one and the same motor 16.

The first display includes a circular graduation 18 and the first drive mechanism is arranged to enable the first indicator to indicate, in a cyclical manner, the value of the first time parameter by rotating in the same direction of rotation, the latter defining the forward direction for the first indicator. The second indicator is driven periodically, i.e. intermittently, when the electromechanical motor 16 is actuated. Thus, the second drive mechanism includes a periodic actuation wheel set 22 able to take successively a set of positions indicated by the divisions 24 and 26 and index 28 in FIG. 1. It will be noted that these divisions and this index have been added to FIG. 1 for the purposes of the description of the invention. However, timepiece movement 2 does not include such a graduation and index since they do not form a display of the timepiece movement. On each step of electromagnetic motor 16, particularly a 180° rotation of its rotor, wheel set 22 makes a small rotation corresponding to one division. This periodic actuation wheel set is arranged such that it drives the second indicator when it is in a first sub-set of positions 24 of said set of positions and when it is driven by the motor from one position to another of the first sub-set of positions. Conversely, the second indicator remains substantially immobile when the periodic actuation wheel set is driven by motor 16 from one position to another in a second sub-set of positions 26 of the set of positions, this second sub-set of positions including a plurality of positions. Further, the first and second drive mechanisms are arranged such that the first indicator 4 can gradually indicate at least one complete cycle of the first time parameter, i.e. make one complete revolution, whereas the periodic actuation wheel set remains in the second sub-set of positions.

According to the invention, the method of controlling the display device is characterized in that the motor 16 is controlled by the timepiece movement 2 such that, when the first indicator 4 is in an operating mode and the second indicator 6 is arranged to remain substantially immobile, first indicator 4 is driven in rotation by the motor alternately.

Specifically, the first indicator is driven in a forward direction, to display the first time parameter, during a first period in which the periodic actuation wheel set 22 is simultaneously driven in positions of the second sub-set of positions, and in a backward direction, in accelerated mode, during a second period following the first period, before the periodic actuation wheel set 22 is driven in a position of the first sub-set of positions. The reverse actuation of the motor, for driving the first indicator in the backward direction, is achieved such that the first indicator correctly displays the first time parameter when the motor is operated in the forward direction again for a following new first period.

According to a particular preferred variant, the end of the first period corresponds to a position of the first indicator 4, on the circular graduation 18, which defines the end of one cycle and the start of the next cycle, i.e. in FIG. 1 to the "60" position merged with the "0" position.

According to another preferred variant, the backward travel of the first indicator during a second period substantially corresponds to the forward travel of the first indicator during the first period directly preceding this second period. In the case of the preceding variant, this means that the number of backward revolutions made in a second period corresponds to the number of forward revolutions made during the preceding first period.

It will be noted that the first sub-set of positions (index 28 facing divisions 24 of FIG. 1) defines an area of actuation (angular sector $\alpha$) of second indicator 6, whereas the second sub-set of positions defines an area of non-actuation (complementary angular sector to angular sector $\alpha$) of the second indicator. When it is intended to actuate the second indicator, the periodic actuation wheel set is arranged to be driven in its area of actuation. Preferably, the second indicator is incremented by one unit on each passage of the periodic actuation wheel set through a continuous, i.e. uninterrupted, area of actuation. Preferably, to change the display of the second indicator, the first indicator is arranged to simultaneously complete an integer number of revolutions, so as not to modify the position of the first indicator if it is inactive (its final position after actuation of the second indicator is identical to its initial position) or not to cause an error in the display of the first indicator after the change of position of the second indicator if the first indicator is active, i.e. operating.

Figure 2:
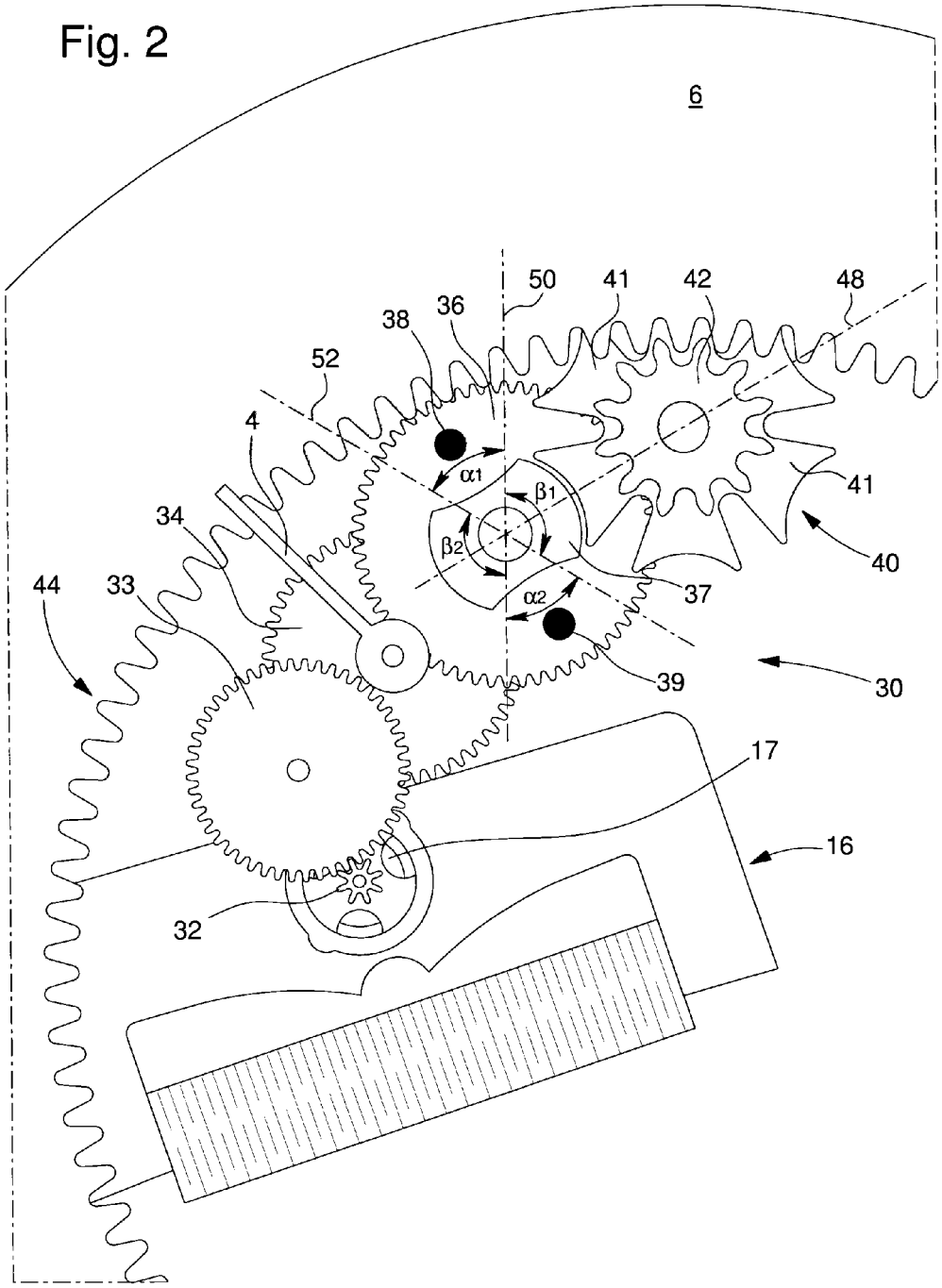
FIG. 2 is a schematic, plan view of a second embodiment of an advantageous timepiece movement for implementing the control method of the invention.

A preferred embodiment of a timepiece movement 30 suitable for the control method of the invention is shown in FIG. 2. In this embodiment, first indicator 4 is a chronograph hand or a "24 hour" hand associated with an off-centre secondary dial. Second indicator 6 is formed by a date ring. The first mechanism associated with the first indicator is formed by a kinematic chain including a pinion 32 of rotor 17 of motor 16, an intermediate wheel 33 and a chronograph wheel 34 integral with chronograph hand 4. The second mechanism associated with the second indicator is formed by a kinematic chain including the first kinematic chain and also a periodic actuation wheel set 36 associated with a Maltese cross 40, the latter being integral with a pinion 42, which meshes with the inner toothing 44 of date ring 6. Wheel set 36 includes a plate with an outer toothing that meshes with a pinion of the chronograph wheel. Above its plate, wheel set 36 includes an oblong central core 37 with two ends in the arc of a circle and two pins 38 and 39 orthogonally aligned on the longitudinal axis of the core.

The Maltese cross includes six flared branches 41 separated by spaces allowing pins 38 and 39 alternately to penetrate between two branches to periodically drive the Maltese cross. Periodic actuation wheel set 36 has an area of actuation, formed by two angular sectors having center angles $\alpha_1$ and $\alpha_2$, and an area of non-actuation formed of two angular sectors having center angles $\beta_1$ and $\beta_2$. The various aforementioned angular sectors are defined in FIG. 2 by two straight dotted lines 50 and 52. These two straight lines define the area of actuation relative to a reference straight line 48 passing through the centre of wheel set 56 and of Maltese cross 40. It will be noted that, in a variant, wheel set 36 may have only one pin (for example pin 38) and the area of actuation is then formed by a single angular sector with a center angle $\alpha_1$. The complementary sector then defines the area of non-actuation. In this variant, the core has a circular periphery over substantially the entire area of non-actuation. It will be noted that the Maltese cross device is advantageous because the central core locks the Maltese cross in the area of non-actuation due to the corresponding profile of branches 41; which ensures that the date ring is held in a stable position outside the intended periods of actuation.

The gear ratio between chronograph wheel 34 and wheel set 36 is such that the chronograph wheel can make several revolutions while wheel set 56 remains in a sector of its area of non-actuation. Therefore, the control method according to the invention may easily be implemented with the same single motor 16 and two indicators 4 and 6. It will be noted that, in order to prevent wheel set 56 entering one of the sectors of its actuation area, the periods of backward rotation of indicator 4 when it is in active mode can be arranged subsequent to each complete revolution of indicator 4, or only after a certain number of revolutions of indicator 4. In each case, it will be ensured, when the timepiece movement is initialised, that wheel set 36 is in an initial position which is sufficiently far from the end of a sector of non-actuation for the intended number of revolutions of the chronograph indicator, before its periodic backward return in accelerated mode, to be performed while wheel set 16 remains in this sector of non-actuation. Next, when the date mechanism is actuated, it will be ensured that, at the end of this function, wheel set 16 is returned to a substantially equivalent position to the initial position in the next sector of non-actuation.

Figure 3:
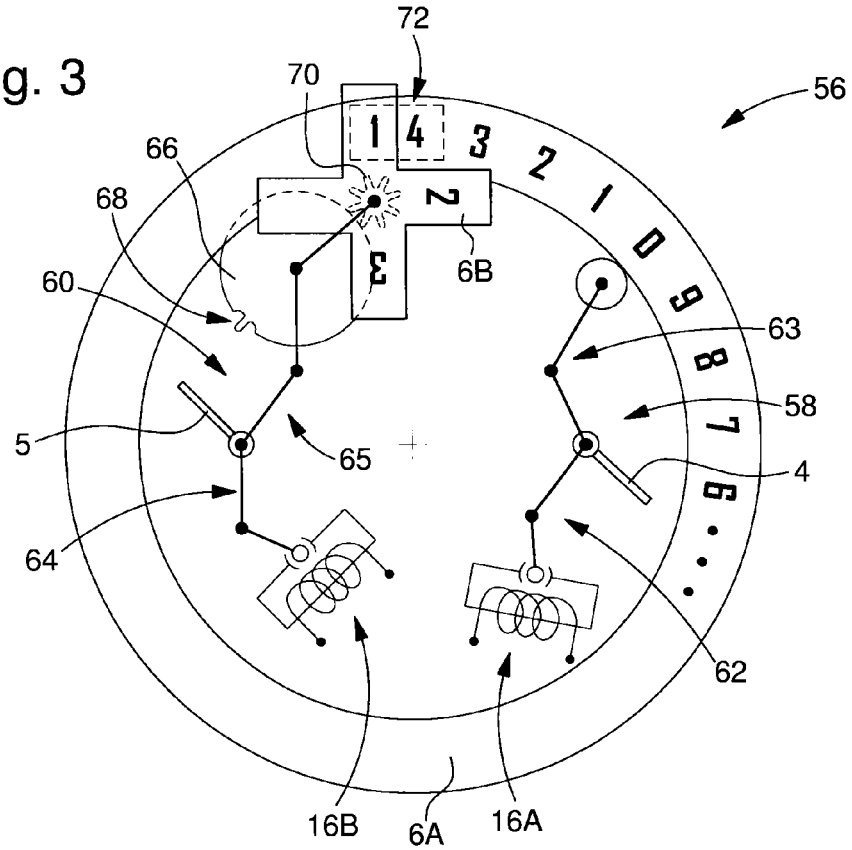
FIG. 3 is a schematic, plan view of a perpetual calendar mechanism with a "large date" appearing in a "grand guichet" or "large date aperture" wherein the tens and units of the date are independently displayed via two analogue indicators respectively associated with two multi-function motors, each controlled by a control method according to the invention.

FIG. 3 is a schematic view of a timepiece movement 56 in which the control method of the invention is implemented for two complementary display devices 58 and 60. This movement includes a "large date" display, also called a "large date aperture" display (schematically represented in FIG. 3 by a rectangle 72 in dotted lines showing a large aperture in the dial of a watch fitted with timepiece movement 56). In a known manner, a "large date" display is generally formed of two distinct indicators 6A and 6B respectively displaying the units and tens of the date. Timepiece movement 56 also includes a chronograph function with two small counters respectively associated with a first chronograph hand 4 and a second chronograph hand 5, defining a display respectively of the measured minutes and hours or half-hours.

According to the invention, ring 6A displaying the units of the date and the first chronograph hand 4, together forming first display device 58, are both actuated by a first electromechanical motor 16A, while the cross 6B displaying the tens of the date and the second chronograph hand 5, together forming second display device 60, are both actuated by a second electromechanical motor 16B. The first display device includes a first kinematic chain 62 between the rotor of motor 16A and chronograph hand 4 and a second kinematic chain 63 between said hand and ring 6A for the units of the date. This first display device may, in particular, be arranged in a similar manner to that described with reference to FIG. 2, and be controlled by the control method of the invention described above. The second display device includes a first kinematic chain 64 between the rotor of motor 16B and chronograph hand 5, and a second kinematic chain 65 between the hand and cross 6B for the tens of the date. The cross drive mechanism incorporates the drive mechanism for chronograph hand 5. In a variant, this latter mechanism may be at least partly distinct from the drive mechanism for cross 6B, as shown in FIG. 1.

Kinematic chain 65 includes a mechanism known as a "Geneva mechanism", which is formed by a periodic drive wheel set 66 and by a small wheel 70 or a pinion which is integral with cross 6B and coaxial thereto. Wheel set 66 has a circular profile over most of its periphery and an actuation finger 68 for small wheel 70. This small wheel includes a toothing with eight teeth. On each revolution of wheel set 66, the small wheel advances by an angular distance corresponding to two teeth; which corresponds to a 90° rotation and therefore to the passage from one branch of the cross to the next in the large aperture 72 of the dial. The toothing of small wheel 70 and the profile of wheel set 66 in the area of finger 68 are arranged so that the small wheel is locked by wheel set 66 when it is not driven by finger 68, i.e. when wheel set 66 is in its area of non-actuation. According to the invention, the kinematic chain 65 is arranged such that chronograph wheel 5 can make at least one complete revolution, preferably several revolutions, while wheel set 66 remains in its area of non-actuation. Indicators 5 and 6B of second display device 60 are respectively also controlled in accordance with the control method of the invention described above. Other large date variants with two rings or coaxial or non-coaxial discs can be driven in a similar manner according to the method of the invention.

What is claimed is:

1. A control method for an analogue display device fitted to a timepiece movement, said analogue display device comprising:

a first indicator associated with a first display for a first time parameter and a second indicator associated with a second display for a second parameter, the first and second indicators being respectively associated with a first drive mechanism and with a second drive mechanism which are actuated by one and the same motor, said first display including a circular graduation and the first drive mechanism being arranged so as to enable the first indicator to indicate, in a cyclical manner, the value of the first time parameter by rotating in the same direction of rotation, the second indicator being periodically driven when said motor is actuated, and the second drive mechanism including a periodic actuation wheel set for periodically actuating said second indicator able successively to take a set of positions, said periodic actuation wheel set being arranged to drive the second indicator when said periodic actuation wheel set is in a first sub-set of positions of said set of positions and to be driven by said motor from one position to the other of the first sub-set of positions, the second indicator remaining substantially immobile when said periodic actuation wheel set is driven by said motor from one position to another in a second sub-set of positions of said set of positions, said second sub-set of positions including a plurality of positions, the first and second drive mechanisms being arranged such that the first indicator can gradually indicate at least one complete cycle of the first time parameter while said wheel set remains in the second sub-set of positions, wherein said motor is controlled by the timepiece movement such that, when the first indicator is in an active operating mode and the second indicator is arranged to remain substantially immobile, said first indicator is driven in rotation by the motor alternately:

in a forward direction, to display said first time parameter, during a first period in which said periodic actuation wheel set is simultaneously driven in positions of the second sub-set of positions, and in a backward direction, in an accelerated mode, during a second period following the first period, before said periodic actuation wheel set is driven in a position of the first sub-set of positions, and wherein reverse actuation of the motor, for driving the first indicator in the backward direction, is achieved such that the first indicator correctly displays the first time parameter when the motor is operated in the forward direction again for a following new first period.

2. The control method according to claim 1, wherein the end of the first period corresponds to a position of the first indicator on a circular graduation defining the end of one cycle and the start of a next cycle.

3. The control method according to claim 1, wherein the backward travel of the first indicator during a said second period substantially corresponds to the forward travel of said first indicator in the first period directly preceding said second period.

4. The control method according to claim 1, wherein the second mechanism includes a Maltese cross periodically driven by said periodic actuation wheel set.

5. The control method according to claim 1, wherein the first indicator is a hand of a chronograph counter.

6. The control method according to claim 1, wherein the second display is the date display.

7. The control method according to claim 1, wherein the second display is the display of the units or of the tens of a large date display, the display of the tens, respectively of the units being achieved by a third indicator driven by a second motor, and wherein the second motor also drives a fourth indicator associated with a fourth display of a time parameter, the third and fourth indicators being respectively controlled in the same manner as the second and first indicators according to the control method of claim 1.

8. The control method according to claim 1, wherein the first sub-set of positions defines an area of actuation of the second indicator, and wherein the second sub-set of positions defines an area of non-actuation of the second indicator.

* * * * *